US006224492B1

(12) United States Patent
Grimes

(10) Patent No.: US 6,224,492 B1
(45) Date of Patent: May 1, 2001

(54) OPTICAL REFERENCE MARKER SYSTEM FOR GOLFERS

(76) Inventor: Patrick Grimes, 100 N. Arlington Ave., Suite 22-C, Reno, NV (US) 89501

( * ) Notice: Subject to any disclaimer, the term of this patent is extended or adjusted under 35 U.S.C. 154(b) by 0 days.

(21) Appl. No.: 09/366,502

(22) Filed: Aug. 3, 1999

(51) Int. Cl.[7] ..... A63B 69/36
(52) U.S. Cl. ..... 473/210; 473/268
(58) Field of Search ..... 473/278, 210, 473/280, 268

(56) References Cited

U.S. PATENT DOCUMENTS

| | | | | |
|---|---|---|---|---|
| 1,790,762 | | 2/1931 | Page . | |
| 3,228,696 | | 1/1966 | Hull . | |
| 3,871,104 | * | 3/1975 | Underhill, II | 473/210 |
| 3,953,033 | | 4/1976 | Kelly et al. . | |
| 4,251,076 | * | 2/1981 | Krupicka | 473/210 |
| 4,957,295 | * | 9/1990 | McConkey | 473/210 |
| 4,991,849 | * | 2/1991 | Fabanich | 473/210 |
| 5,444,501 | * | 8/1995 | Aloi et al. | 473/210 |
| 5,489,953 | * | 2/1996 | Gritthith | 473/210 |
| 5,657,869 | * | 8/1997 | Carroll, III | 206/451 |

OTHER PUBLICATIONS

The applicant hereby discloses that the subject matter of the current application is relevant to U.S. patent application Ser. No. 08/861,258, filed on May 21, 1997, now abandoned.

* cited by examiner

*Primary Examiner*—Steven Wong
(74) *Attorney, Agent, or Firm*—Ian F. Burns

(57) ABSTRACT

An optical reference marker system comprising at least one optical reference marker and a storage member, wherein the storage member is adapted to hold the optical reference marker. The optical reference marker typically comprises a thin film material such as vinyl, and is adapted to be removably attached to a lens on a pair of glasses on a golfer's head. Thus, a golfer may select the appropriate optical reference marker for the ensuing shot, and thereafter return it to the storage member, which may comprise a laminated card.

20 Claims, 3 Drawing Sheets

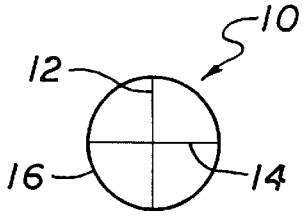
FIG.1A
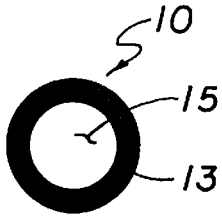
FIG.1B
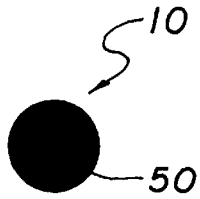
FIG.1C
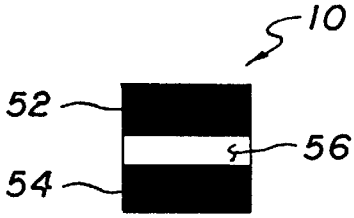
FIG.1D
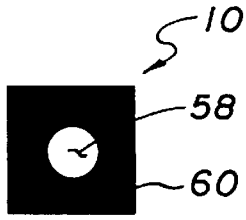
FIG.1E
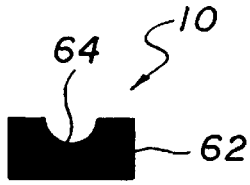
FIG.1F
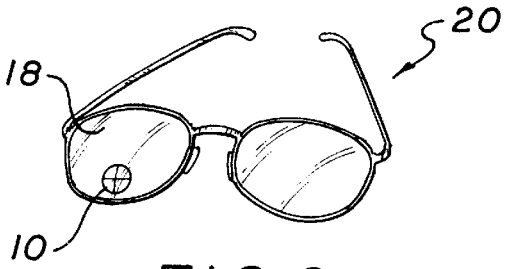
FIG.2A
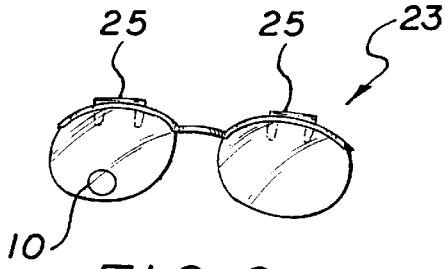
FIG.2B
FIG.3
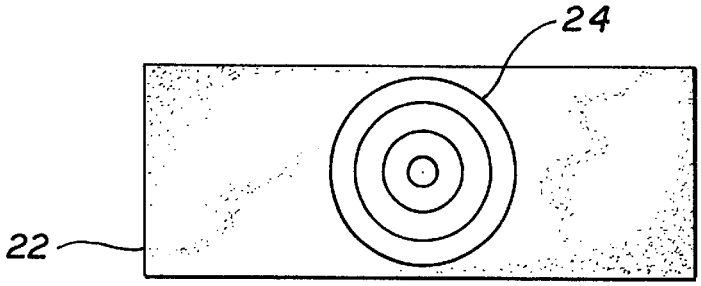
FIG.4
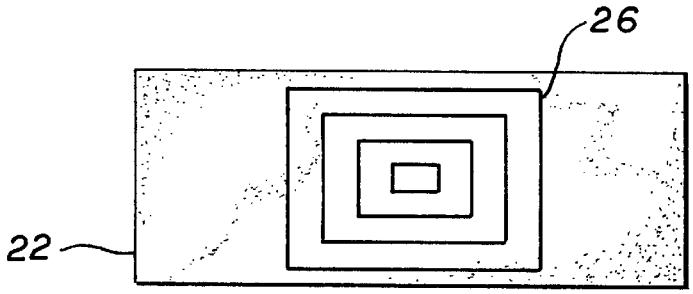

FIG. 5
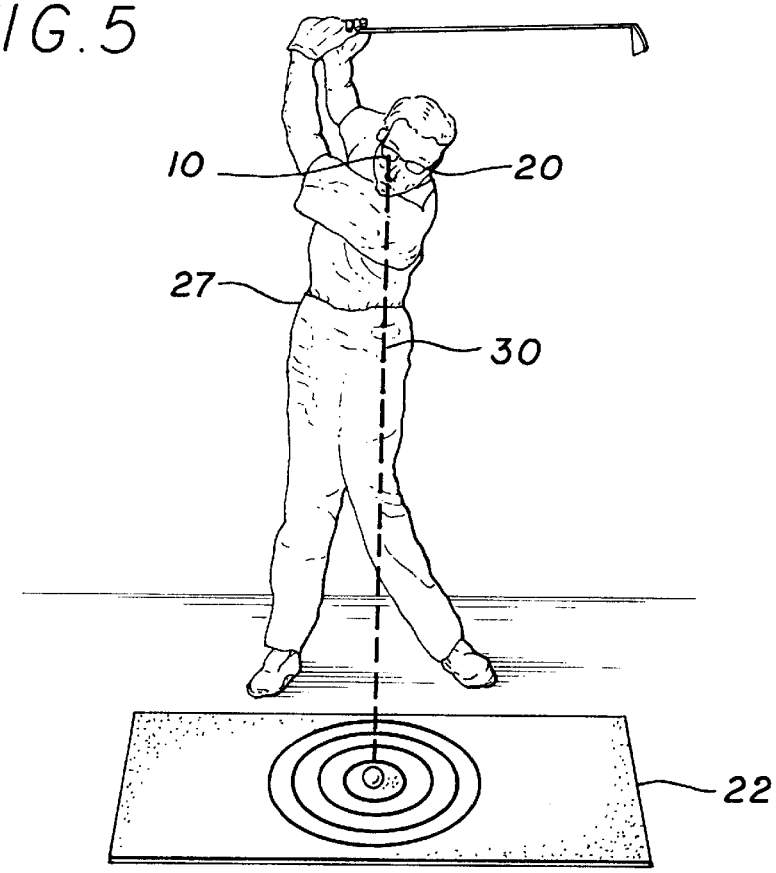
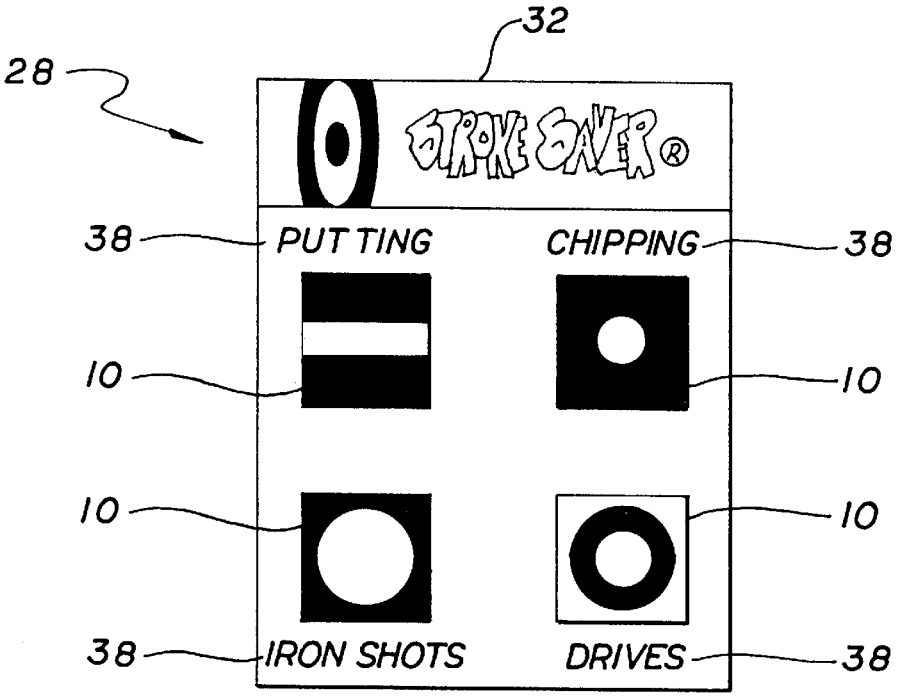
FIG. 6

FIG. 7
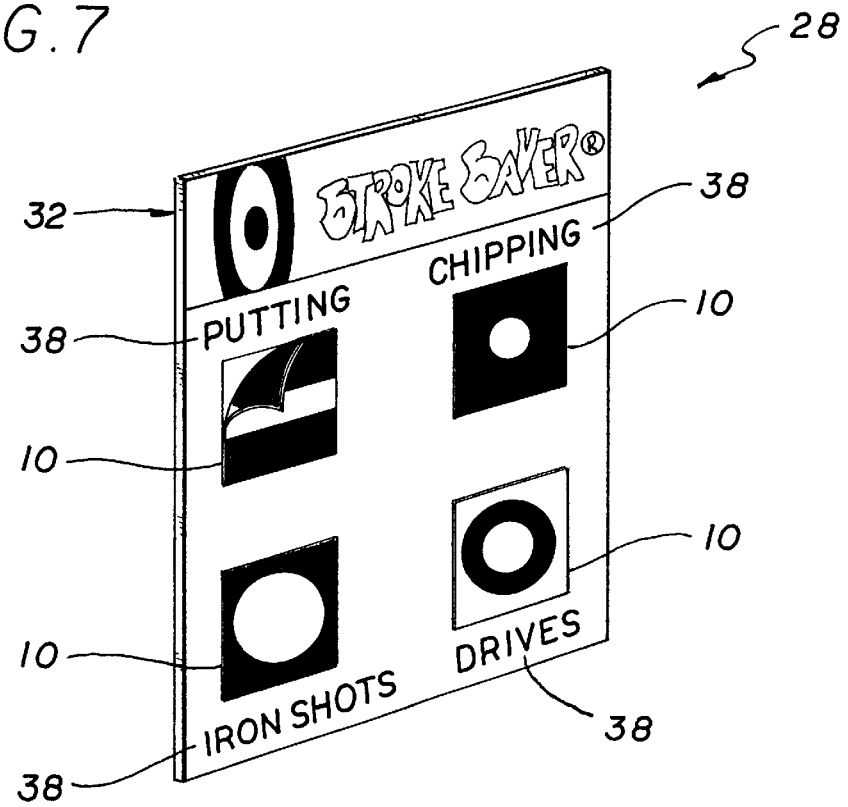
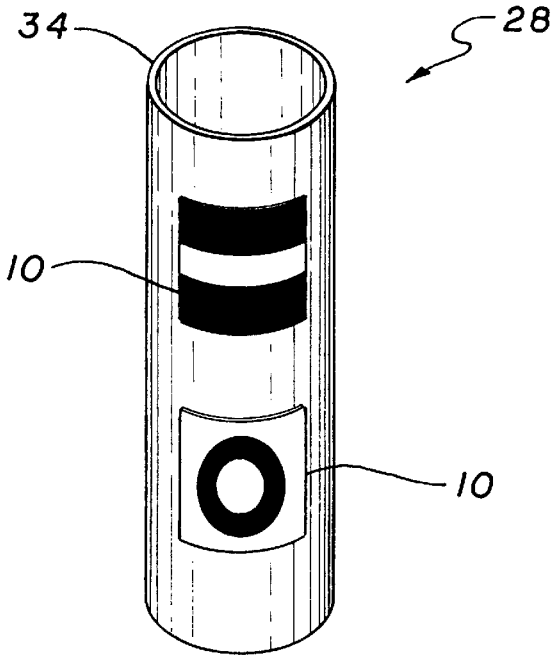
FIG. 8

OPTICAL REFERENCE MARKER SYSTEM FOR GOLFERS

FIELD OF THE INVENTION

The present invention relates to an optical reference marker system for training golfers to maintain proper head and body position when performing a golf swing.

DESCRIPTION OF THE RELATED ART

In golf, the golf swing (as used herein to include all varieties of golf swings, i.e. putting, pitching, driving, etc.) is the most important aspect of a golfer's game. A proper golf swing allows a golfer to accurately hit a golf ball to a desired location. In order to attain a proper swing, a golfer must maintain proper head and body position.

Head position is a critical component of all types of golf swings. Proper head position during the golfer's entire swing, both the backward and forward portion of the swing, is imperative for the golfer to achieve the proper angle and position of the golf club when it strikes a ball. Proper head position is realized when a golfer's head does not move (up or down or side to side) until after the golf club has made contact with the golf ball and the golfer is in the "follow through" portion of the golf swing. At this point the golfer's head may rise to follow the ball.

Eye contact provides an effective means of maintaining proper head position. When the golfer's eyes remain fixed on a golf ball or other reference point during a swing, the head tends to remain in its proper position. A common mistake among inexperienced golfers is to loose direct eye contact with the ball during the backward and forward portions of the swing. Typically, when a golfer has lost direct eye contact with a ball, the golfer's head moves out of its proper position. This movement of the golfer's head causes the golfer's body to move out of its proper position, which in turn causes instability and small movements in the golf club. The golf club then strikes the golf ball at undesirable angles and positions, which adversely effects the golfer's accuracy and power.

Some golfers have trained themselves to maintain eye contact with the ball but have not trained themselves to keep their head in one position. These golfers move their eyes independently from their head. Thus, it is not always sufficient to keep one's eye on the ball. Golfers must be trained to keep their eye on the ball while keeping their head in one position during a swing.

Various devices have been developed for helping golfers maintain proper head and body position. U.S. Pat. No. 3,228,696 to Hull, for instance, discloses a pair of glasses or sunglasses fitted with a target sight or optical reference marker (a decal or an engraving placed on each lens) that provides a means for training golfers to maintain a desired head position. When a golfer views a golf ball or other reference point through the optical reference marker, the golfer must maintain the golfer's head in one position. If the golfer's head changes position during a swing, the golf ball will move out of the optical reference marker.

Hull, however, discloses only one optical reference marker, a circle with a clear or transparent center. It has been found that other shapes are useful to train golfers. For example, some shapes are better able to indicate how a golfer is moving his head and body and the severity of that movement. Furthermore, different golfers prefer different optical reference marker shapes.

It has also been found that golfers require a convenient means for storing and transporting the optical reference markers. If a golfer uses a removably attachable marker, the golfer needs a means for storing the marker until the golfer needs to use it. If a plurality of markers are used, golfers require a means for clearly displaying the markers so that golfers can easily select a marker.

SUMMARY OF THE INVENTION

The present invention comprises an optical reference marker system for training a golfer or assisting a golfer in the game of golf. The system comprises at least one optical reference marker and a storage member. The optical reference marker is adapted to be removably attached to a lens on a pair of glasses on the golfer's head, wherein the optical reference marker provides a reference point to maintain a desired body position during a golf swing when the optical reference marker is aligned between an eye of the golfer and an object. The storage member is adapted to hold the optical reference marker, wherein the optical reference marker may be stored on the storage member when not in use, and the optical reference marker may be removed from the storage member when the golfer desires to use the optical reference marker.

BRIEF DESCRIPTION OF THE DRAWINGS

FIG. 1A is substantially a front view of first embodiment of an optical reference marker of the present invention.

FIG. 1B is substantially a front view of a second embodiment of an optical reference marker of the present invention.

FIG. 1C is substantially a front view of a third embodiment of an optical reference marker of the present invention.

FIG. 1D is substantially a front view of a fourth embodiment of an optical reference marker of the present invention.

FIG. 1E is substantially a front view of a fifth embodiment of an optical reference marker of the present invention.

FIG. 1F is substantially a front view of a sixth embodiment of an optical reference marker of the present invention.

FIG. 2A is substantially an isometric front view of a pair of glasses with the reference marker of FIG. 1A attached to the glasses.

FIG. 2B is substantially a front view of a pair of clip-on glasses with the reference marker of FIG. 1B attached to the glasses.

FIG. 3 is substantially a top view of a mat of the present invention.

FIG. 4 is substantially a top view of an alternative embodiment of the mat in FIG. 3.

FIG. 5 is an example of a golfer using the devices of FIGS. 1, 2, and 3.

FIG. 6 is substantially a front plan view of one embodiment of the optical reference marker system of the present invention.

FIG. 7 is substantially a side plan view of one embodiment of the optical reference marker system of the present invention, wherein one of the optical reference markers is partially removed.

FIG. 8 is an isometric view of a second embodiment of the optical reference marker system of the present invention.

DESCRIPTION OF THE PREFERRED EMBODIMENT

Optical Reference Marker

As seen in FIGS. 1 and 2, the optical reference marker system of the present invention comprises an optical reference marker 10. Marker 10 preferably comprises a film material, such as plastic or vinyl. Marker 10 may be coated with an adhesive that allows the marker to be removably attached to a pair of glasses. Alternatively, marker 10 may comprise a material, such as vinyl, that naturally adheres to glass or plastic surfaces without an adhesive. Such materials are often used to place removable stickers on glass. Opaque or partially opaque regions may comprise black ink or any other distinguishable colors. If plastic is used, the ink may be printed on the plastic or the plastic may be died, using methods that are well known in the art, when the vinyl is manufactured. Each of the optical referenced markers may be manufactured so that the transparent regions are merely absent of the opaque material. For example, if the markers are made of vinyl, the opaque regions may be formed by the vinyl material and the transparent regions may be formed by the absence of the material.

Marker 10 may be formed with many different opaque and transparent patterns. For example, the embodiment disclosed in FIG. 1A comprises cross hairs 12 and 14 and it may also comprise a borderline 16. This embodiment may be useful for golfers who prefer highly accurate alignment. This embodiment also has the advantage that it has very small regions of opaque material that interfere little with the user's vision.

The embodiment disclosed in FIG. 1B utilizes an opaque ring 13 with a transparent central region 15. This embodiment may be best suited to golfers who tend to move their head a large amount.

The embodiment in FIG. 1C is an opaque circle or dot 50. This embodiment may be suitable to golfers who tend to move their heads less. When this embodiment is used, the golfer would cover the golf ball or reference point with the opaque circle 50.

The embodiment in FIG. 1D has an upper opaque region 52 and a lower opaque region 54 separated by a transparent band 56. This embodiment may be best suited to putting because the transparent band allows the golfer to glance sideways to view a nearby hole.

FIG. 1E represents an embodiment in which a transparent region 58 is surrounded by a larger opaque region 60. This embodiment may be best suited to golfers who wish to block distracting objects, such as bushes and sand trap borders, from their view. In FIG. 1F, opaque region 60 has a square or rectangular shape.

The embodiment in FIG. 1F utilizes an opaque region 62 with a semicircular indentation or transparent region 64. This embodiment does not limit the golfer's view in one direction. In FIG. 1F, the transparent region 64 is on the upper side of opaque region 62. This allows the golfer to see every thing above marker 10.

The optical reference markers described above are only a few of the large number of possible reference markers, which may be used according to a golfer's preferences. It is also possible to combine two or more markers to achieve a customized shape.

Glasses

As seen in FIG. 2A, optical reference marker 10 may be placed on a lens 18 of glasses 20. The user may place marker 10 in many different locations on lens 18 to achieve maximum comfort and functionality. For example, some users may wish to have marker 10 on the lower part of lens 18 while other users may wish to have marker 10 in the middle of lens 18.

FIG. 2B represents an alternative use for reference marker 10 in which marker 10 is placed on a pair of clip-on glasses 23. Clips 25 allow glasses 23 to be temporarily attached to a standard pair of glasses. This allows a golfer to remove glasses 23 or flip them out of the way so that optical reference marker 10 is removed from the golfer's line of sight when it is not needed.

Target Mat

As seen in FIG. 3, target mat 22 of the present invention comprises a substantial flat object material that may be placed in front of a user during practice. The material is durable enough to sustain repeated impacts of a golf club and it may contain padding to further protect the underlying floor or ground. Markings or a pattern 24 may be provided to determine the accuracy of a golfer's practice swing. Pattern 24 may take a number of different configurations. One possible configuration is a "bull's eye" pattern which has a plurality of concentric rings or regions, which may have different colors. Another possible pattern 26, as seen in FIG. 4, has a plurality of concentric rectangles or squares of different color.

Normal Use

In normal use, optical reference marker 10 is placed on the lens of a pair of glasses that corresponds to the user's dominant eye. For example, a golfer with a dominant left eye would place marker 10 on the left lens. The dominant eye is usually on the same side of the user's body as the user's favored hand. For example, if the user is right handed, the user's dominant eye is usually the user's right eye.

The use of optical reference marker 10 and mat 22 is depicted in FIG. 5. A golfer 27 positions the golfer's body such that the center of target mat 22 is aligned with marker 10. Alternatively, the user may use an actual golf ball or other object as the target. With the target and the marker aligned, the golfer can perform a backward and forward motion of a swing and be cognizant of not only all head and body movements but the severity thereof. By keeping marker 10 and the object aligned, the user will keep the golfer's head stationary during his golf swing. This will result in the proper form and improved performance.

Golfers may use mat 22 alone to practice without actually hitting golf balls. This is especially useful when a golfer is indoors. Practice is accomplished by aligning optical reference marker 10 with a portion of pattern 24. When the golfer swings, the golfer can observe the path of the golf club to determine the accuracy of the swing. Pattern 24 provides a means for observing the relative motion of the golf club.

When target mat 22 is not used, the golfer can focus on a golf ball to analyze improvement during the backward and forward motion of a swing. This is of particular importance when the golfer is playing on a golf course.

Storage and Display Device

As seen in FIGS. 6–8, the present invention also comprises a storage member 28 that is adapted to store, display, and transport optical reference marker 10. Storage member 28 preferably has a surface that is adapted to receive one or more markers 10. Markers 10 may be attached to storage member 28 by a variety of methods. For example, if marker 10 utilizes an adhesive, the adhesive may be used to removably attach the markers to storage member 28. In the preferred embodiment, markers 10 are vinyl and the surface of storage member 28 is smooth. Thus, the tendency of vinyl to adhere to smooth surfaces may be used to removably attach the markers 10 to storage member 28. Other materials, such as tacky rubber, may also be used to achieve this result.

In the preferred embodiment, a plurality of markers 10 with different optical patterns are stored on the surface of storage member 28. Thus, a golfer may select from a variety of markers 10 to use in a given situation. Once the golfer has selected the appropriate marker 10, the golfer may remove the maker by peeling the marker from storage member 28. Once the golfer has finished using marker 10, the golfer may replace the marker on storage member 28 for storage and future use.

Storage member 28 may be in a variety of different shapes. In the preferred embodiment storage member 28 is a substantially planar rectangular or square card 32, depicted in FIGS. 6 and 7, that is formed by a plastic laminated paper card. Card 32 provides a convenient shape for displaying markers 10 and it may be easily stored in a golfer's cloths or golf bag. Card 32 may be placed in a plastic bag and hung from a hook for sale at a golf shop. Card 32 may also contain instructions for use, rules, maps, statistics, graphics, and other information that explain the use of markers 10 or are otherwise provide useful information to the golfer. For example, card 32 may be customized for a particular golf course by displaying a map of the golf course on the back of the card. As seen in FIGS. 6 and 7, storage member 28 may comprise a plurality of marker labels 38, wherein each label 38 refers to the marker best suited for a particular situation.

In an alternative embodiment, seen in FIG. 8, golfer 27 comprises a tube 34 that is adapted to hold one or more golf balls. Thus, when a golfer purchases a set of golf balls, the golfer also receives a set of markers 10. Many other containers and objects may be used as golfer 27.

What is claimed is:

1. An optical reference marker kit for training a golfer to maintain a desired body position in the game of golf, the golfer wearing a pair of glasses on the golfer's head, the glasses having at least one lens in front of an eye of the golfer, the kit comprising:

(A) at least one reusable optical reference marker, the optical reference marker comprising at least two optical regions, the regions having different optical transmission characteristics, the optical reference marker being adapted to be removably attached to the lens on the pair of glasses, wherein the optical reference marker provides a reference point to maintain a desired body position during a golf swing when the optical reference marker is aligned between the eye of the golfer and a reference point; and (B) a storage member, the storage member being adapted to hold the optical reference marker, wherein the optical reference marker may be stored on the storage member when not in use, the optical reference marker may be removed from the storage member when the golfer desires to use the optical reference marker, and the optical reference marker may be replaced on the storage member after use.

2. The kit of claim 1 wherein the optical reference marker comprises a vinyl material.

3. The kit of claim 2 wherein one region of the optical reference marker is substantially opaque, and the other is region is substantially transparent.

4. The kit of claim 1 wherein the storage member comprises a substantially planar card.

5. The kit of claim 1 wherein the storage member comprises a substantially smooth surface.

6. The kit of claim 1 wherein the storage member comprises a plastic laminated paper card.

7. The kit of claim 1 wherein the storage member comprises a tube.

8. The kit of claim 1 wherein the storage member displays information useful to a golfer.

9. The kit of claim 1 wherein the optical reference marker comprises a film material.

10. A method of storing, displaying, and transporting an optical reference marker, comprising the following steps:

(A) providing at least one reusable optical reference marker, the optical reference marker comprising at least two optical regions, the regions having different optical transmission characteristics, the optical reference marker being adapted to be removably attached to a lens on a pair of glasses, the glasses being adapted to be worn by a golfer, wherein the optical reference marker provides a reference point to maintain a desired body position during a golf swing when the optical reference marker is aligned between an eye of the golfer and an object;

(B) providing a storage member, the storage member being adapted to removably receive the optical reference marker, wherein the optical reference marker may be stored on the storage member when not in use, and the optical reference marker may be removed from the storage member when the golfer desires to use the optical reference marker, and the optical reference marker may be replaced on the storage member after use; and (C) placing the optical reference marker on the storage member.

11. The method of claim 10 further comprising the step of displaying the optical reference marker on the storage member.

12. The method of claim 10 further comprising the step of removing the optical reference marker from the storage member and removably attaching the optical reference marker on a pair of glasses for use by a golfer.

13. The method of claim 12 further comprising removing the optical reference marker from the glasses and removably attaching the optical reference marker to the storage member.

14. The method of claim 11 wherein the step of providing a storage member comprises providing a substantially planar card.

15. An optical reference marker system for training a golfer or assisting a golfer in the game of golf, the golfer wearing a pair of glasses on the golfer's head, the glasses having at least one lens in front of an eye of the golfer, the system comprising:

(A) a plurality of reusable optical reference markers, each optical reference marker comprising at least two optical regions, the regions having different optical transmission characteristics, each optical reference markers being adapted to be removably attached to the lens on the pair of glasses, wherein the optical reference marker provides a reference point to maintain a desired body position during a golf swing when the optical reference marker is aligned between the eye of the golfer and an object; and (B) a storage member, the storage member being adapted to hold the optical reference markers, wherein the optical reference markers may be stored on the storage member when not in use, and the optical reference markers may be removed from the storage member when the golfer desires to use the optical reference markers, and the optical reference markers may be replaced on the storage member after use.

16. The system of claim 15 wherein the storage member comprises a substantially planar card.

17. The system of claim 15 wherein the storage member comprises a substantially smooth outer surface.

18. The system of claim 15 wherein the storage member comprises a plastic laminated paper card.

19. The system of claim 15 wherein the storage member displays information useful to a golfer.

20. The system of claim 15 wherein the optical reference marker comprises a thin film material.

* * * * *